US005630343A

United States Patent [19]

Begin

[11] Patent Number: 5,630,343

[45] Date of Patent: May 20, 1997

[54] POWER DRIVE MULTIPLE SOCKET WRENCH

[76] Inventor: Paul Begin, 145 Whipple Rd., Pascoag, R.I. 02856

[21] Appl. No.: 567,670

[22] Filed: Dec. 5, 1995

Related U.S. Application Data

[63] Continuation-in-part of Ser. No. 209,529, Mar. 11, 1994, abandoned.

[51] Int. Cl.[6] ..... B25B 17/00

[52] U.S. Cl. ..... 81/57.46; 81/57.29; 81/57.13

[58] Field of Search ..... 81/57.13, 57.29, 81/57.3, 57.4, 5.46

[56] References Cited

U.S. PATENT DOCUMENTS

| | | | |
|---|---|---|---|
| 2,603,976 | 7/1952 | Hilton | 81/57.29 X |
| 3,430,510 | 3/1969 | Hendrickson | 81/57.29 X |
| 4,510,825 | 4/1985 | Neron et al. | 81/57.29 |
| 4,517,861 | 5/1985 | Stemberger | 81/57.29 |
| 5,277,087 | 1/1994 | Wilson et al. | 81/57.29 |
| 5,345,845 | 9/1994 | Myers | 81/57.29 |

*Primary Examiner*—James G. Smith

*Attorney, Agent, or Firm*—Pravel, Hewitt, Kimball & Krieger

[57] ABSTRACT

An improved power socket wrench which includes a handle portion and a power drive portion. The handle portion further provides an internal drive shaft extending through the handle portion, for engaging, tangentially, a geared drive gear in the power drive portion of the wrench. The drive gear further provides a laterally extending hub member which is able to accommodate a plurality of interchangeable sockets, metric and non-metric, during use without having to interchange parts in the power drive portion. Upon rotation of the internal drive shaft, the drive gear within the power drive portion imparts rotation to the socket, for tightening or loosening the bolt or nut in question. The wrench of the present invention further comprising an improvement over the prior art in that a single ball bearing located within the wrench adjustably constrains the axial motion and force of the drive shaft when the wrench is operated in a drive direction, and oil light bronze fittings constrain the axial motion and force of the drive shaft when in is operated in a reverse direction.

1 Claim, 5 Drawing Sheets

POWER DRIVE MULTIPLE SOCKET WRENCH

RELATED APPLICATION DATA

This application is a continuation-in-part application of application Ser. No. 08/209,529, filed Mar. 11, 1994 abandoned, which is incorporated herein by reference.

BACKGROUND OF THE INVENTION

1. Field Of The Invention

The present invention relates to wrenches. More particularly, the present invention relates to a hand-held power socket wrench, wherein the drive mechanism tangentially engages a drive gear to impart rotation to the power drive, which is adapted to receive a plurality of metric and non-metric sized sockets. Still more particularly, the present invention relates to an improved wrench assembly for right angle torque transmission comprising the improvement of a single ball bearing located within the wrench to adjustably constrain the axial motion and force of the drive shaft when the wrench is operated in a drive direction. Further, oil light bronze fittings constrain the axial motion and force of the drive shaft when it is operated in a reverse direction.

2. General Background

In the use of hand-held wrenches, under normal circumstances, the wrench is operated by rotational movement of the handle portion in an arc, following the engagement of a bolt head or nut by the hub or jaws portion of the wrench. However, in certain circumstances, the wrench is inserted into a very confined area, so that the movement of the handle portion of the wrench in an arc, in order to loosen or tighten the nut or bolt, is impossible, due to the confined space available. Even in the field of what are called ratchet wrenches, which allow ratching movement of the wrench for loosening or tightening, an oscillating movement of the handle is required, and again, in confined spaces, it becomes an impossibility. Therefore, there have been developed a line of wrenches, which utilize a shaft extending through the handle of the wrench, which engages a hub, so that rotation of the internal shaft, imparts rotation to the hub. The hub is affixed with a socket-type feature, so that the bolt head or nut fits snugly in the socket, and thus may be rotated as the hub is rotated.

There are several patents in the art which address this feature, the most significant found in a prior art search noted as follows:

U.S. Pat. No. 1,415,731, issued to Terry also discloses a ratchet wrench, having an internal pawl feature, which ratchets similarly to conventional ratchet wrenches.

U.S. Pat. No. 1,698,618, issued to Bigelow, operates in part as a power wrench by rotation of the handle, but in order to undertake the final tightening, the handle must be manually moved in an arc, which is difficult in a confined space.

U.S. Pat. No. 2,764,048, issued to Thompson discloses a ratchet wrench utilizing a geared relationship between the handle and the hub portion of the wrench. However, the invention, as a ratchet wrench still requires the ratcheting movement of the wrench handle which is difficult in confined spaces.

U.S. Pat. No. 4,362,072, issued to Tillman relates to a wrench having an internal shaft in the handle, a disk on the head of the wrench, which is gearingly engaged to the shaft, so that rotation of the shaft imparts rotation to the disc. The disc has an aperture which engages the nut. However, in this particular arrangement, the disc must be replaced to accommodate different size nuts or bolts, which is a difficult task during operation.

U.S. Pat. No. 4,592,254, issued to Wallis operates as a ratchet wrench by movement of a portion of the handle inward toward the head, so as to impart rotational movement to the drive head.

U.S. Pat. No. 5,090,273, issued in 1992, teaches a ratchet wrench, which does not have a handle member to drive the drive head, but is generally a ratchet wrench of the typical design.

U.S. Pat. No. 4,517,861, issued to Stemberger, teaches a right angle torque wrench. However, and importantly, in the Stemberger wrench, the axial motion created by driving the drive shaft and worm gear is constrained only by traditional ball bearings located around the end of the drive shaft (as shown in, e.g., FIGS. 3 and 12 of Stemberger). Compared to the improvement of the instant invention, the in-line, single ball bearing, the Stemberger wrench is clearly inferior to the wrench of the instant invention, as it does not adequately constrain axial motion and force as does the instant invention.

U.S. Pat. No. 5,345,845, issued to Myers, also teaches a right angle torque wrench. However, and importantly, like the Stemberger wrench, in the Myers wrench, the axial motion created by driving the drive shaft and worm gear is constrained only by traditional ball bearings located around the drive shaft (as shown in, e.g., FIG. 5 of the Myers patent). Like the Stemberger wrench, when compared to the improvement of the instant invention, the in-line, single ball bearing, the Myers wrench is clearly inferior to the wrench of the instant invention, as it does not adequately constrain axial motion and force as does the instant invention.

Importantly, all of the prior art wrenches fail to teach the critical improvement of the instant invention, the placement of a single, adjustable, in-line ball bearing at the end of the drive shaft, within the wrench, which provides adjustable control over the axial forces generated when the drive shaft is rotated in the forward, or drive, direction, when constraint upon the produced axial force is particularly necessary.

SUMMARY OF THE PRESENT INVENTION

The apparatus of the present invention solves the shortcomings in the art in a simple and straightforward manner. What is provided is an improved power socket wrench which includes a handle portion and a head portion. The handle portion further provides an internal drive shaft extending through the handle portion, for engaging, tangentially, a geared drive gear in the head portion of the wrench. The drive gear further provides a laterally extending adaptor which is able to accommodate a plurality of interchangeable sockets, metric and non-metric, during use without having to interchange parts in the head portion. Upon rotation of the internal drive shaft, the drive gear within the head portion imparts rotation to the socket, for tightening or loosening the bolt or nut in question. Unlike the prior art wrenches, the instant invention contains the significant improvement of having a single axially aligned ball bearing located in the head portion at the end of the drive shaft for adjustably controlling the axial motion and force of the drive shaft when the drive shaft is rotated axially in a forward, driving direction, when such constraint is particularly needed.

Prior art wrenches do not provide this significant advantage, and attempt to control the axial motion and force of the driving drive shaft through the use of conventional ball bearings surrounding the drive shaft—not at the end of the drive shaft where such control is most needed and effective. As a result, the wrenches of the prior art are significantly limited in the amount of axial strain that can be applied during operation, particularly during driving. This, in turn, substantially limits the usefulness of the wrenches in actual operation.

Further, the prior art's use of traditional ball bearings surrounding the drive shaft precludes the ability of the wrench operator to easily adjust the level of the axial force control in normal wrench operation. However, the present invention allows the operator of the wrench to easily adjust the level of axial force control by simply adjusting the Allen nut inwardly or outwardly through the wall of the head portion. For example, enhanced control can be provided by simply turning the Allen nut, with an ordinary Allen wrench engaged in the Allen nut, so that it extends further into the head portion, by virtue of its reversible threading through the wall of the head portion and more tightly constrains the ball bearing. In contrast, by merely turning the nut to reverse the nut and back it out, the level of control over the axial force can readily be reversed.

Further, the instant invention provides oil light bronze bearings located near the second end of the first gear element between the inner wall of the elongated handle portion and the drive shaft (see parts list and Figures infra) in order to constrain axial motion and force when the drive shaft is rotated in the reverse direction, such as when removing nuts.

It is a principal object of the present invention to provide a hand-held power wrench which is powered by a drive member in the handle of the wrench, and having a hub which can accommodate a plurality of interchangeable sockets;

It is a further object of the present invention to provide a hand-held power wrench which imparts power to the head of the wrench through rotation of a power drive member in the handle of the wrench, the wrench adapted to receive a plurality of sockets;

It is a further object of the present invention to provide a power driven wrench having a drive shaft through the handle for engaging the wrench head, which is easy to use, accommodates numerous socket sizes, and has few moving parts;

It is a further object of the present invention to provide an improved right angle torque transmission wrench with a single axially aligned, and adjustable, ball bearing serving as an improved means of controlling axial movement and force when the drive shaft is operated in a forward direction; and It is a further object of the instant invention to provide oil light bronze bearings to constrain the axial movement and force when the drive shaft is operated in a reverse direction.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
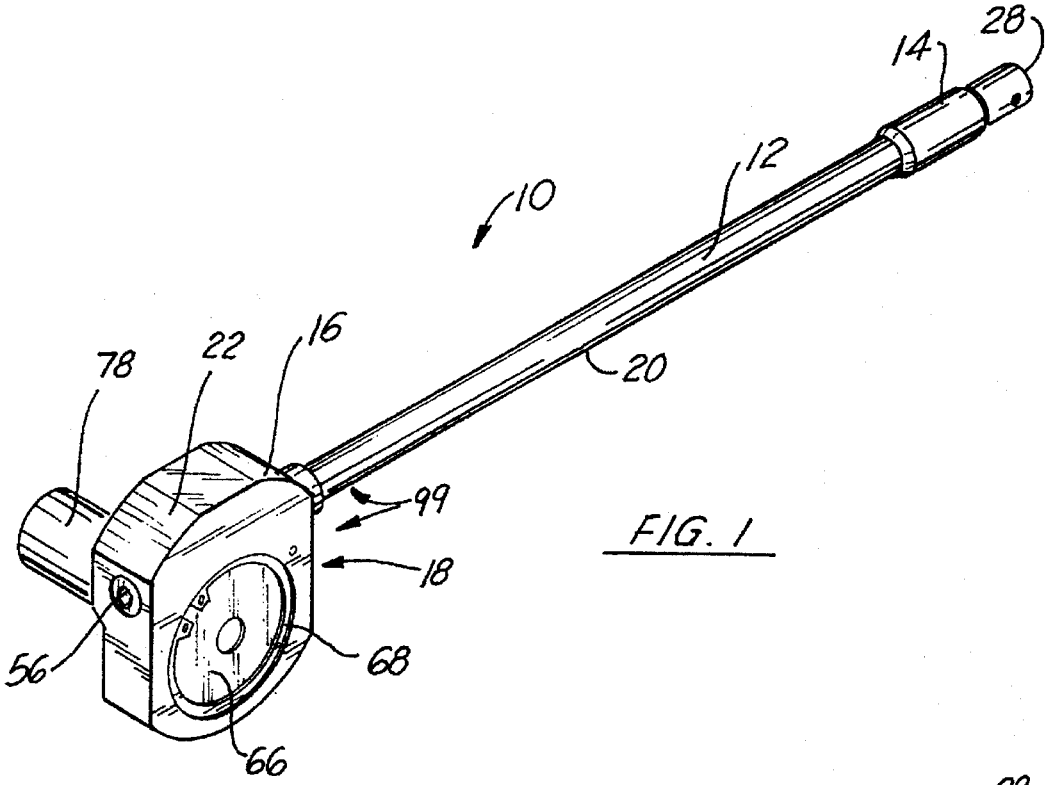
FIGS. 1 and 2 illustrate overall views of the preferred embodiment of the power wrench of the present invention.
Figure 2:
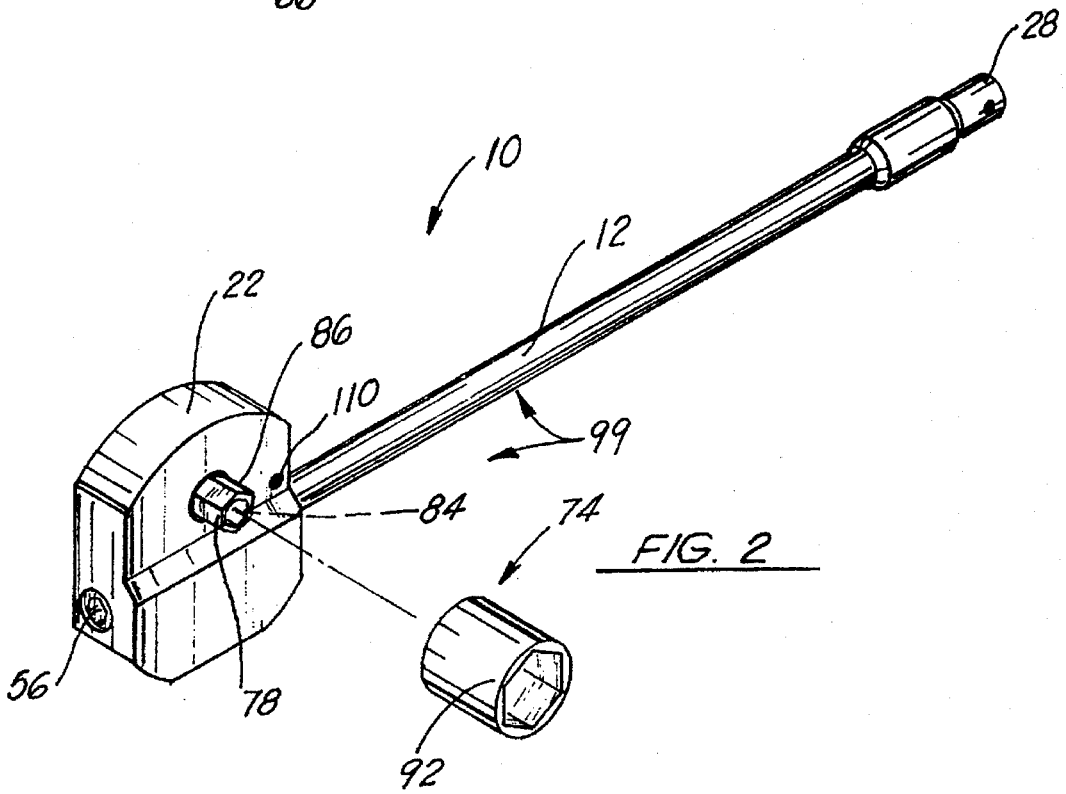

FIGS. 1 through 7 illustrate the preferred embodiment of the present invention by the numeral 10. As illustrated in the figures, wrench assembly 10 comprises overall a substantially elongated handle member 12, having a first distal end 14, and a second end 16, which is secured to head portion 18, via pin 19 as seen in the drawings. Generally, handle member 12 would be circular in cross-section for easy grasping and would include a continuous outer wall 20. The second end 16 of handle 12 would be inserted into an opening, first bore 21, in the outer housing 22 of drive head portion 18, and would be maintained in place via a pin 19. Pin 19 would be inserted into a second bore 110, in outer housing 22 of drive head portion 18, and would be set in a semicircular opening 23 in the wall 20 of the handle. Attaching handle 12 in this manner to the outer housing 22, provides a secure attachment means for operation of the wrench.

Figure 3:
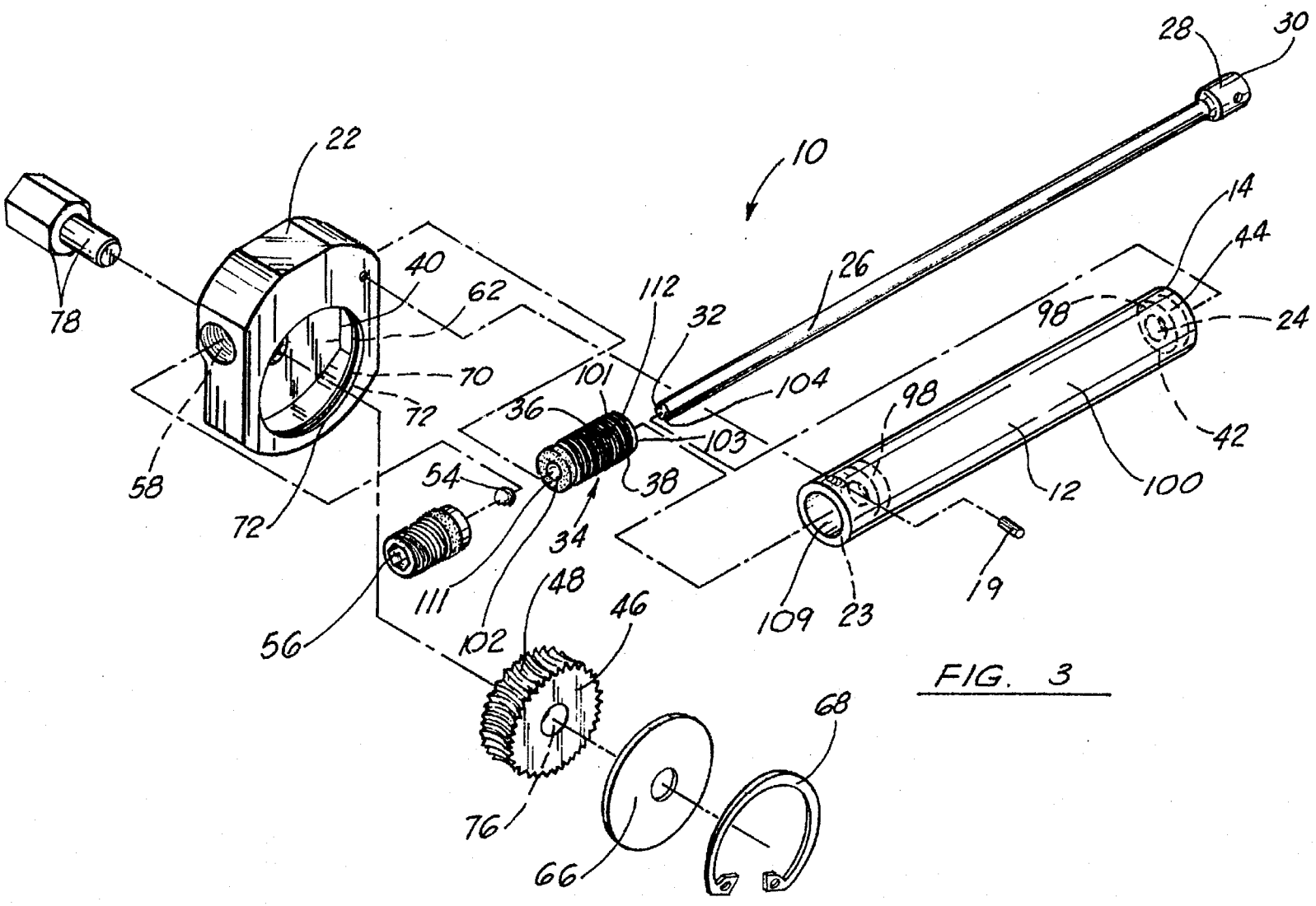
FIG. 3 illustrates an exploded view of the preferred embodiment of the power wrench of the present invention.
Figure 4:
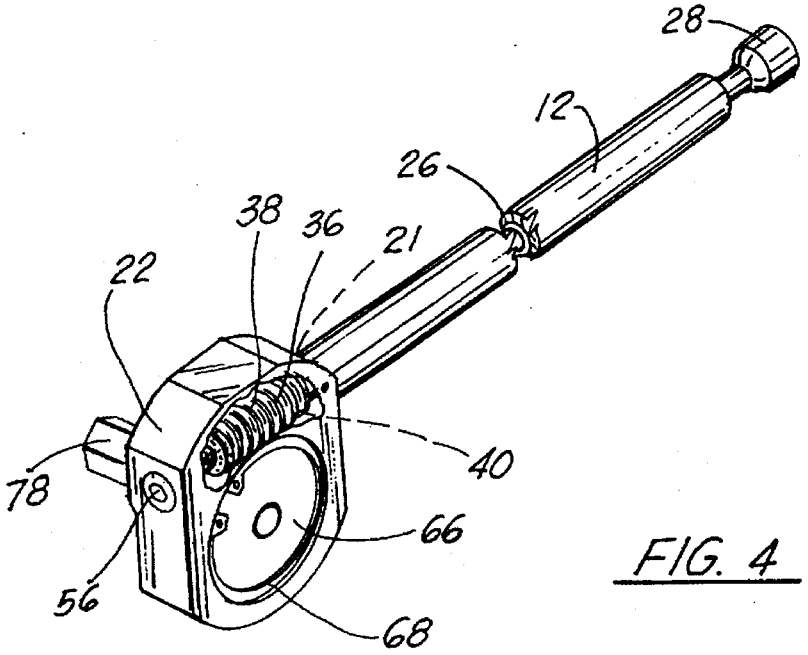
FIG. 4 illustrates a partial cutaway view of the preferred embodiment of the power wrench of the present invention.

Turning now to the operation of the wrench, reference is made to FIG. 3, where there is illustrated in exploded view, the internal mechanism which provides the operation to wrench 10. As illustrated, handle 12 includes an internal bore 24 through its length, for accommodating an internal, elongated drive shaft 26 therethrough. The first distal end 28 of drive shaft 26 protrudes out from the first distal end 14 of handle 12, and includes a drive socket 30, the operation of which will be described further. The second end 32 of internal drive shaft 26 extends through first gear element 36, through third bore 111. Shear pin 101 extends through first gear element 36, through shear pin bore 112, to attach inner drive shaft 26 to fist gear element 36. First gear element 36 is preferably a worm gear, of the type well known in the art, having a continuous thread 38 about the body of the first gear element 36. The worm gear 36 surrounding and attached to drive shaft 26 is positioned within a hollow interior of head portion 40, so that when drive shaft 26 is rotated, worm gear 36 undergoes rotation within the hollow interior of head portion 40. As illustrated, the shaft 26 is highly lubricated at several points 42, 44 along handle 12, so as to facilitate easy rotation during use.

Figure 6:
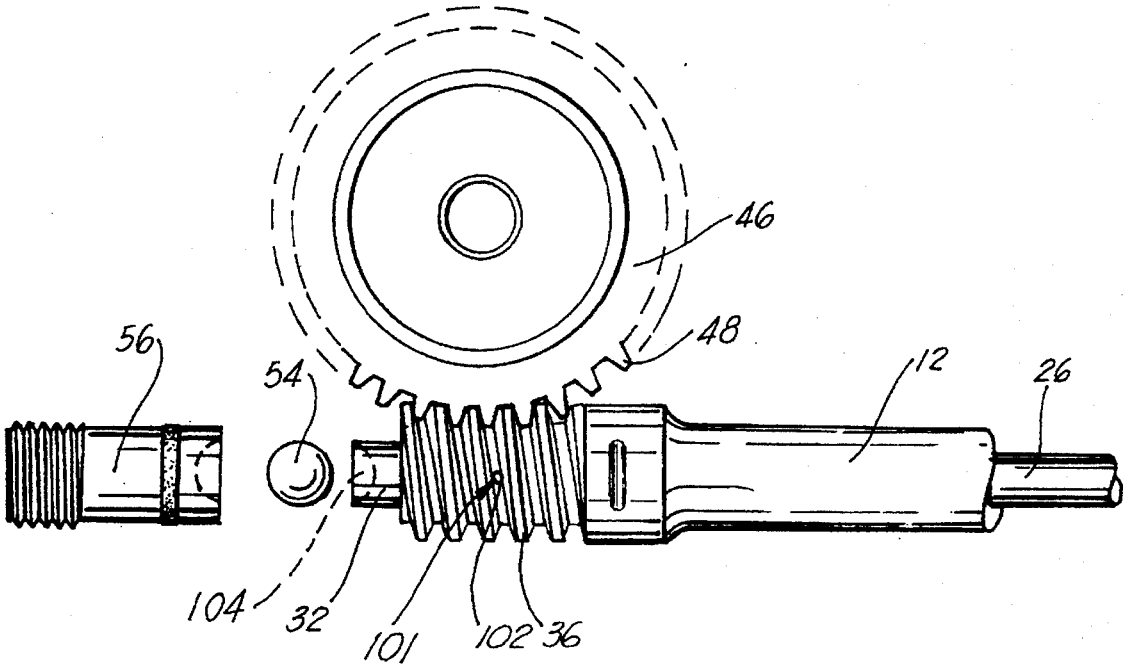
FIG. 6 illustrates an isolated view of the worm gear assembly of the preferred embodiment of the present invention.

As seen further in FIG. 3, first gear element 36 would interact in meshing driven engagement with second gear element 46, second gear element 46, circular in cross section, and having a plurality of gear teeth 48 along its outer edge, which interact with the continuous thread 38 of worm gear 36 as is seen in FIG. 6. Before turning to the operation of the wrench 10, reference is further made to FIG. 3, where it is seen that the end portion 32 of drive shaft 26 extends beyond first gear element 36, and includes a hemispherically recessed end 104 into which seats a single ball bearing 54.

Figure 7:
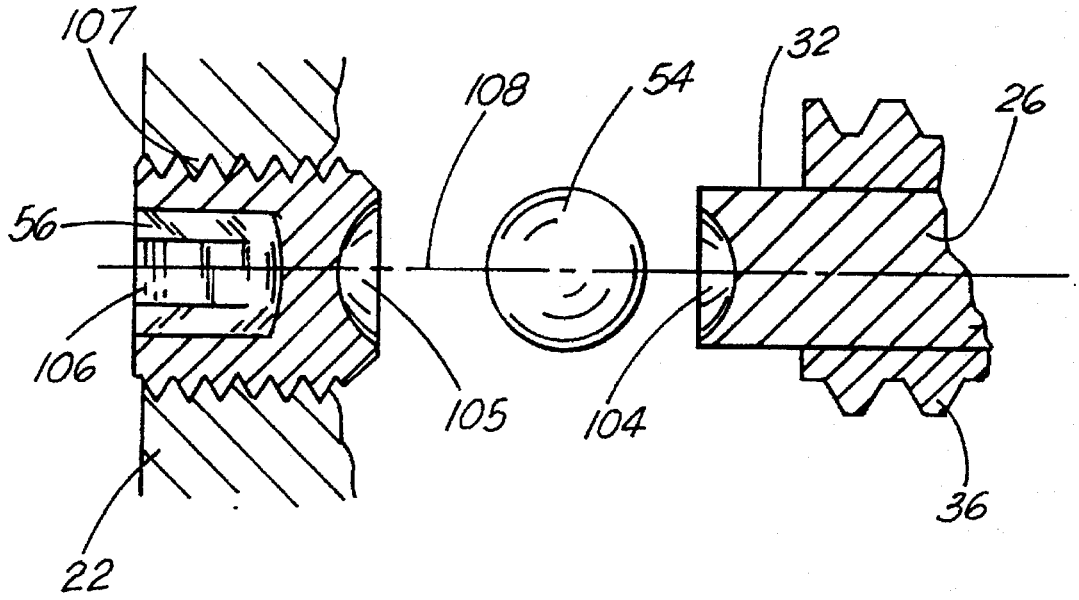
FIG. 7 illustrates an isolated view of the single ball bearing axialy, and adjustably, cradled between the recessed end of the drive shaft and the recessed end of the Allen nut, itself adjustably threaded through the wall of the head portion.

As further shown in FIGS. 3, 6 and 7, ball bearing member 54 is maintained in position via Allen nut 56, which is reversibly threaded into a fourth bore 58 in outer housing 22 of drive head portion 18. Axial line 108 in FIG. 7 illustrates the relationship of the ball bearing member 54 to the drive shaft 26 and Allen nut 56.

As shown in detain in FIG. 7, ball bearing 54 is adjustably cradled between the hemispherically recessed end of drive shaft 104 and a hemispherically recessed end 105 of the Allen nut 56. It can be seen that by engaging Allen nut 56 with a conventional Allen wrench in Allen socket for Allen nut 106, Allen nut 56 can be turned so as to either advance it into the hollow interior of head portion 40, via 107, the reversible threading of the Allen nut through the outer housing of the head portion, or retreat it. Said adjustments affecting the tightness with which ball bearing 54 is cradled between hemispherically recessed end portions 104 and 104; said adjustments affecting the degree to which ball bearing 54 controls the axial motion and force created when drive shaft 26 rotates the assembly in a forward, driving direction.

Furthermore, first gear element 36 within chamber 40 is stabilized by the end point 104 of drive shaft 26 being so seated as described, and the rotation of drive shaft 26 is facilitated by bearing 54. Furthermore, bearing 54 serves as a means for disallowing the worm gear 36 from moving forward within chamber 40 during rotation, as wormgears are apt to do. The bearing 54 provides a rotation surface for the end 104 of shaft 26 during manipulation of the gear.

As illustrated further in FIG. 3, outer housing 22 includes the circular opening 62. A cover plate member 66 is positioned in place within opening 62 to seal head 22. Plate member 66 held in place by a locking ring 68 in a slot 70 in the circular end wall 72 of circular opening 62.

Drive shaft 26 may further be rotated by engaging a standard socket wrench into drive socket 30, thereby turning shaft 26 via engagement of socket 30 with an external driving wrench.

Figure 5:
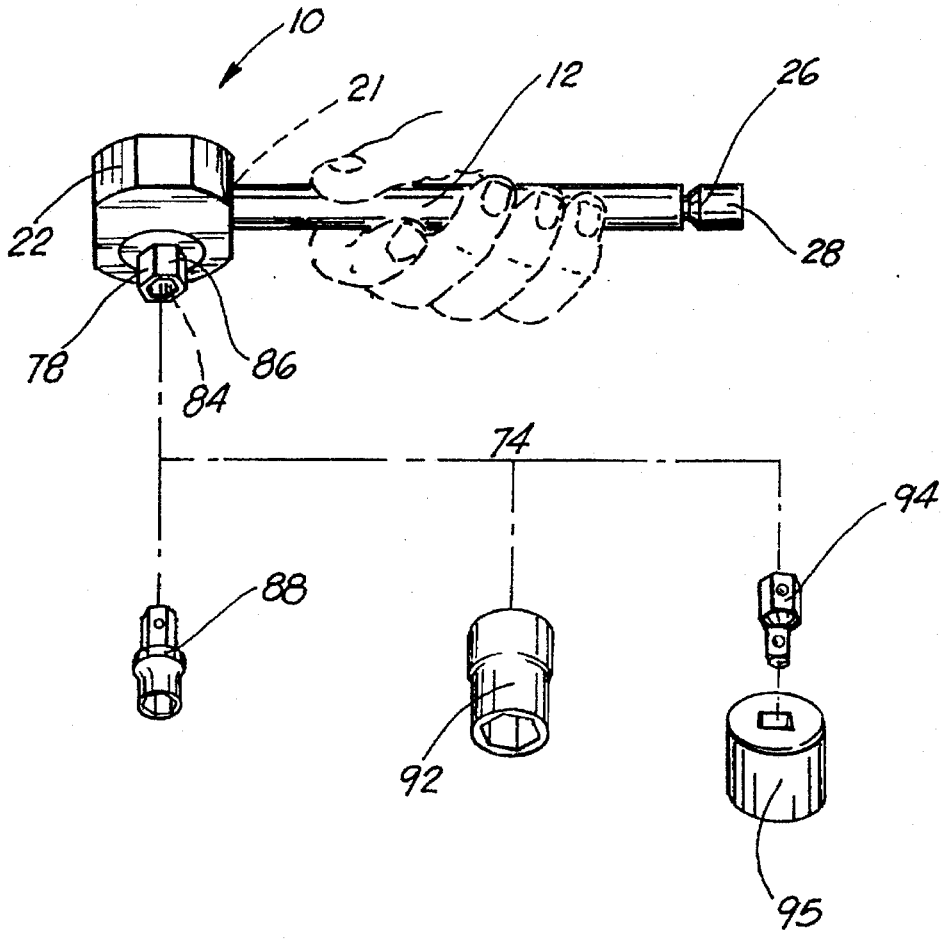
FIG. 5 illustrates a view of the preferred embodiment of the power wrench of the present invention accommodating multiple sockets.

As shown in FIG. 5, adaptor 78 is able to accommodate a plurality of sockets 74 during operation, without having to dismantle the wrench or go to any great trouble in the interchanging of sockets. As shown in FIGS. 3 and 5, this is achieved by second gear element 46 including a fifth bore 76 for accommodating adaptor 78 locked therein. In the preferred embodiment, the fifth 76 would accommodate adaptor 78 which is known as an O-socket, which is a six-sided socket member (also known as a hex-drive socket), which has an inner bore 84 having six sides, and an outer wall 86 having six sides. Thus, a smaller male drive socket 88 could be positioned within the inner bore 84 of the adaptor/hex-drive socket 78, or a larger female socket 92 could be placed around the wall 86 of adaptor/hex-drive socket 78. In that manner, the wrench 10 is able to accommodate several different sizes of drive sockets. In fact, in the event a square drive socket 95 were to be utilized, the adaptor/hex-drive socket 78 could accommodate a drive adaptor 94 within bore 84, and the square socket 85 could be attached thereon as illustrated in FIG. 5.

Therefore, in operation, the proper socket would be placed onto adaptor/ratchet 78 positioned in the bore 76 of second gear element 46. The socket would then engage the nut of a bolt to loosen or tighten. As described above, depending on the job to be done, the distal end 28 of drive shaft 26 could be rotated by affixing a ratchet wrench to drive socket 30. The drive shaft 26 would then be rotated in the proper direction, which would impart rotation of drive second gear element 46, via first gear element 36. The socket would then, of course, tighten or loosen bolt or nut. Of course, while bolt or nut is loose, internal drive shaft 26 could be rotated manually, until a ratchet would have to be utilized.

There is further provided, as shown in FIG. 3, oil light bronze fittings, or bearings, 98 located at positions 98, between the drive shaft 26 and the inner surface of the elongated drive member 109. These fittings/bearings 98 span the space between the drive shaft 26 and the handle member 12 thereby stabilizing the drive shaft 26 within the interior of the hollow interior of the handle portion. Further, oil light bronze bearings/fittings 98, located near the first gear element 36 provide stabilization against axial movement and force when the drive shaft 26 is rotated in a reverse driving direction.

In the makeup of wrench it is important that the components are very sturdily built for use. That is, it is preferred that first gear element 36 be made of a hardened, tempered steel, and there be oil light bronze fittings 98 between handle 12 and internal drive shaft 26 at strategic points of contact.

The following table lists the part numbers and part descriptions as used herein and in the drawings attached hereto.

PARTS LIST

| Part Number | Description |
|---|---|
| 10 | wrench assembly |
| 12 | substantially elongated handle member |
| 14 | first distal end of handle member |
| 16 | second end of handle member |
| 18 | head portion |
| 19 | pin |
| 20 | outer wall of handle |
| 21 | first bore |
| 22 | outer housing of head portion |
| 23 | semi-circular opening |
| 24 | internal bore |
| 26 | elongated drive shaft |
| 28 | first distal end of drive shaft |
| 30 | drive socket |
| 32 | second end of drive shaft |
| 36 | first gear element |
| 38 | continuous thread |
| 40 | hollow interior of head portion |
| 42, 44 | lubrication points |
| 46 | second gear element |
| 48 | gear teeth |
| 54 | ball bearing |
| 56 | Allen nut |
| 58 | fourth bore |
| 62 | circular opening |
| 66 | cover plate member |
| 68 | locking ring |
| 70 | slot |
| 72 | circular end wall |
| 74 | sockets |
| 76 | fifth bore |
| 78 | adaptor |
| 84 | inner bore of adaptor |
| 86 | outer wall of adaptor |
| 88 | male drive socket |
| 92 | female socket |
| 94 | drive adaptor |
| 95 | square socket |
| 98 | oil light bronze fittings |
| 99 | housing |
| 100 | hollow interior portion of substantially elongated handle member |
| 101 | shear pin |
| 102 | first end of first gear element |
| 103 | second end of first gear element |
| 104 | hemispherically recessed end of drive shaft |
| 105 | hemispherically recessed end of Allen nut |
| 106 | driving socket for Allen nut |
| 107 | threading of Allen nut through outer housing of head portion |

-continued

| PARTS LIST | |
|---|---|
| Part Number | Description |
| 108 | axial alignment of Allen nut, ball bearing and drive shaft |
| 109 | inner surface of elongated handle member |
| 110 | second bore |
| 111 | third bore |
| 112 | shear pin bore |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A wrench assembly for right angle torque transmission comprising a housing having a substantially elongated configuration with a hollow interior portion, said housing further including a head portion, said head portion having an outer housing and a hollow interior; a driving device for driving said wrench assembly including an elongated drive shaft having an axis and being rotatably mounted within said hollow interior portion and including a first gear element at one end thereof adjacent said head portion, said first gear element having a first end located adjacent said head portion and a second end located opposite said first end; said driving device further comprising a second gear element movably mounted within said housing in meshing driven engagement with said first gear element, whereby rotation of said drive shaft causes rotation of said first and second gear elements; an adaptor connected to said second gear element and projecting outwardly from said housing at about 90° relative to the axis of said driving device, said adaptor engageable with a wrench socket, such that rotation of said driving device causes rotation of said first and second gear elements which causes rotation of said adaptor which, when fitted with a wrench socket, can drive a socket wrench, with the turning socket projecting outwardly from said housing at about 90° relative to the axis of said driving device, the improvement comprising:

a) said drive shaft extending through and beyond said first end of said first gear element, the extending end portion of said drive shaft having a hemispherically recessed end;

b) an Allen nut having a hemispherically recessed end, said Allen nut being located opposite the hemispherically recessed end of said drive shaft, said Allen nut being threaded through said outer housing of said head portion and extending inwardly toward the hemispherically recessed end of the drive shaft and generally axially aligned with the axis of said drive shaft;

c) a single spherically shaped ball bearing located and cradled between said recessed end of said drive shaft and said recessed end of said Allen nut thereby creating a cradled ball connection; and d) the cradled ball connection being adjustable by the threaded Allen nut so as to constrain the axial motion and force of the drive shaft when the drive shaft is rotated axially in the forward direction when the socket is rotated in a forward, driving direction.

* * * * *